US005247756A

United States Patent [19]

Johnstone

[11] Patent Number: 5,247,756

[45] Date of Patent: Sep. 28, 1993

[54] SIGN APPARATUS WITH INSERTIBLE DIRECTIONAL ARROW

[76] Inventor: Robert M. Johnstone, 196 Lakeview Dr., Fairfield, Conn. 06430

[21] Appl. No.: 946,248

[22] Filed: Sep. 17, 1992

Related U.S. Application Data

[63] Continuation of Ser. No. 814,200, Dec. 23, 1991, abandoned, which is a continuation of Ser. No. 591,902, Oct. 2, 1990, abandoned.

[51] Int. Cl.[5] ..... G09F 13/04

[52] U.S. Cl. ..... 40/570; 40/580; 220/284; 220/307; 403/345; 403/375

[58] Field of Search ..... 40/570, 576, 579, 580, 40/583, 550, 452, 622; 362/456; 220/284, 307; 403/353, 345, 375, 380

[56] References Cited

U.S. PATENT DOCUMENTS

| | | | |
|---|---|---|---|
| 3,402,494 | 9/1968 | Gray . | |
| 3,445,030 | 5/1969 | Lutzker | 220/307 |
| 3,478,455 | 11/1969 | Fremont . | |
| 3,620,403 | 11/1971 | Rump | 220/306 X |
| 3,665,626 | 5/1972 | Lund et al. . | |
| 3,931,689 | 1/1976 | Shine | 40/570 |
| 4,103,804 | 8/1978 | Fournier et al. | 220/307 X |
| 4,258,487 | 3/1981 | Hohorst | 40/299 |
| 4,355,479 | 10/1982 | Thornton | 40/570 |
| 4,458,825 | 7/1984 | Holota | 220/307 |
| 4,784,285 | 11/1988 | Patel | 220/307 |
| 4,889,380 | 12/1989 | Pillifant, Jr. | 40/658 |
| 4,905,861 | 3/1990 | Boxall et al. | 220/284 |
| 4,934,554 | 6/1990 | Edwards | 220/307 |
| 5,069,357 | 12/1991 | Anderson | 220/307 |

*Primary Examiner*—James R. Brittain
*Assistant Examiner*—Brian K. Green

[57] ABSTRACT

A removable and reinsertible arrow cover for a sign stencil. The cover is equipped with an edge bevel, a tongue and an edge snap rail positioned remotely of the tongue to facilitate snap action insertion and removal as well as a snug, flush fit which provides a closed seal to the passage of light with an arrow shaped void in the stencil.

8 Claims, 3 Drawing Sheets

SIGN APPARATUS WITH INSERTIBLE DIRECTIONAL ARROW

This application is a continuation of application Ser. No. 814,200, filed Dec. 23, 1991, now abandoned, which is a continuation of application Ser. No. 591,902, filed Oct. 2, 1990, now abandoned.

FIELD OF THE INVENTION

This invention relates to a sign apparatus and, in particular, to a novel and improved exit sign which is universal, for uses where direction indication is either needed (left or right) or not needed.

Exit signs are useful in public buildings to designate an exit from the building either directly or indirectly via stairs, corridors and the like. Where the exit sign is mounted directly above the passageway, there is no need for a directional indication. In other cases the exit sign may be located, for instance, in a corridor some distance away from the actual exit passageway. For these cases, a directional indicator, such as an arrow, pointing to the right or the left, as the case may be, is required.

BACKGROUND OF THE INVENTION

In one type of known exit sign, right or left directional arrows are partially formed in the sign stencil, but maintained within the stencil voids or perforations attached by tabs (arrow knockouts). At the time of sign installation, the workman removes one of the arrow knockouts, for example, the left one for a left indicator. However, if the workman removes the wrong arrow knockout, it cannot be replaced and another sign must be used. The "wrong" arrow knockout sign must either be used in another location (if there is one) or discarded as useless.

There are some known exit signs in which mistakes at installation are correctable without the sign becoming useless. Thus, U.S. Pat. No. 3,402,494 discloses an exit sign in which the sign stencil has a void in the shape of a double headed arrow and a cover with an arrow tail imprinted thereon for mounting on and covering one of the arrow heads so as to give the impression of a composite arrow with head and tail pointing in the same direction. However, the mounting hardware acts in an interference fashion to score or broach during insertion such that removal is difficult and reuse is unlikely. In addition, the installed cover projects from the stencil surface and is therefore visible and has a third appearance.

Other known exit signs, exemplified by U.S. Pat. Nos. 3,478,455 and 3,665,626, have an exit sign stencil with one or more rectangular voids and an arrow mask stencil slidably arranged behind the rectangular void so as to present in register with the rectangular void a directional arrow in one position and a blank cover in another position. These slidable mask members can be easily tampered with on the job and are subject to being jarred loose or out of position so as to mistakenly present the wrong image.

BRIEF SUMMARY OF THE INVENTION

An object of the invention is to provide novel and improved sign apparatus having a directional arrow cover that is insertable as well as reusable.

Another object of the invention is to provide novel and improved sign apparatus in which an insertable arrow cover fits snugly within an arrow shaped void in the stencil of the sign as well as flush with the surface of such stencil.

Yet another object of the present invention is to provide an arrow cover for an exit sign that is shaped to fit snugly into a corresponding arrow shaped void in the stencil of the exit sign and flush with the front surface of the stencil.

Still another object of the invention is to provide an arrow cover for an exit sign shaped to fit so snugly within an arrow shaped void in the exit sign stencil such that light from within the sign enclosure does not escape.

Briefly, the invention is embodied in sign apparatus which has a stencil with a pattern of perforations therein. The sign has a source of illumination which acts to illuminate the stencil and its pattern of voids. At least one of the voids has an arrow shape for the purpose of indicating direction. The arrow shaped void is adapted to be obscured by a cover which has an arrow shape and dimensions substantially the same as the arrow shaped void so as to fit snugly therein and to be flush with the front surface of the stencil. A mounting means is provided for the arrow cover and arrow void to achieve the snug fit flush with the stencil surface leaving an almost invisible surface continuity.

The mounting means comprises a bead formed on the edges of the arrow shaped void in the stencil. The edges of the cover are beveled inwardly from its front surface so as to provide a snug fit against the bead and a closed seal to the passage of light when inserted in the stencil void. A notch is formed in the rear surface of the stencil in a location that encompasses the directional point of the arrow shaped void. The arrow cover is provided with a tongue arranged on its rear surface and projecting from its directional point so as to reside in the stencil notch when so inserted. A snap rail is located on the arrow cover edge opposite to its directional point and shaped to mate with the bead of a corresponding edge of the arrow shaped void.

The arrow cover is readily inserted manually by initially positioning the arrow cover tongue partially within the notch, applying pressure from the snap rail edge toward the notch and toward the stencil front surface so that the arrow cover slides forwardly further into the notch and into the stencil void until the snap rail snaps over the beaded edge of the void and into position. There is no scoring or broaching of the material. The arrow cover can simply be removed by applying pressure from the rear side of the stencil toward the front.

DESCRIPTION OF PREFERRED EMBODIMENT

The sign apparatus and insertable directional arrow cover of the present invention are useful in any sign application where a directional arrow is needed. However, by way of example and completeness of description, the invention will be described in a preferred embodiment for an exit sign.

Figure 1:
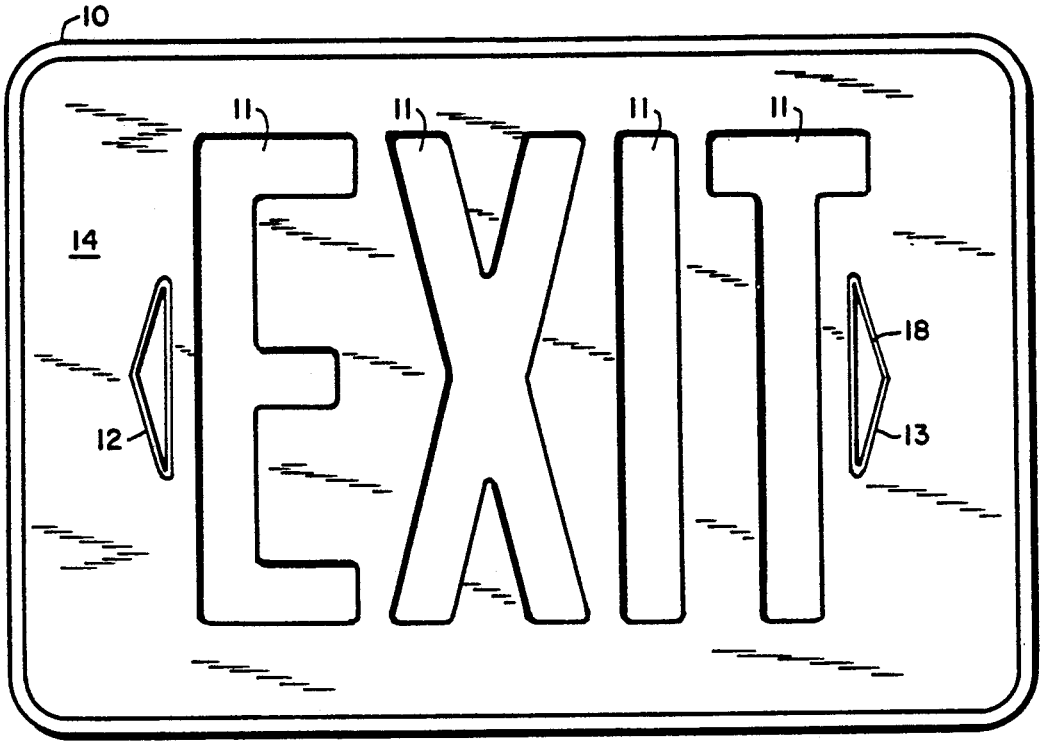
FIG. 1 is a plan view of the front surface of a stencil for sign apparatus.

There is shown in FIG. 1 a plan view of the front surface 14 of a stencil for sign apparatus embodying the present invention. The sign apparatus may assume any suitable form, as for example, the forms shown in U.S Pat. Nos. 3,931,689 or 4,561,203 or in co-pending application Ser. No. 315,949, filed Feb. 23, 1989, now U.S. Pat. No. 5,018,290, granted May 28, 1991, Ser. No. 591,719, filed Oct. 2, 1990, entitled "Exit Sign With Removable Emergency Power Pack", all of which are incorporated herein by reference. In general, these signs include a light source which is positioned to the rear of the stencil so as to illuminate the stencil image through a colored stencil.

The stencil 10 has an image formed by a plurality of voids, openings or perforations. Voids 11 form the word "Exit", while voids 12 and 13 have arrow shapes and point in the left hand and right hand directions, respectively.

In accordance with the present invention, the arrow shaped voids are adapted to receive arrow covers of substantially identical shape and dimensions. The covers fit snugly within the arrow shaped voids so as to effectively block the passage of light. The voids 12 and 13 and the corresponding arrow covers are given geometries which provide the snug fit and which facilitate easy manual insertion on the job and either manual or screwdriver assisted removal with snap action.

The arrow voids 12 and 13 are each of a substantially identical construction except that void 12 is arranged to point in the left hand direction and arrow void 13 is arranged to point in the right hand direction. For the sake of convenience, only arrow void 13 will be illustrated in detail in FIGS. 2 through 7, it being understood that arrow void 12 has a substantially identical construction.

Figure 2:
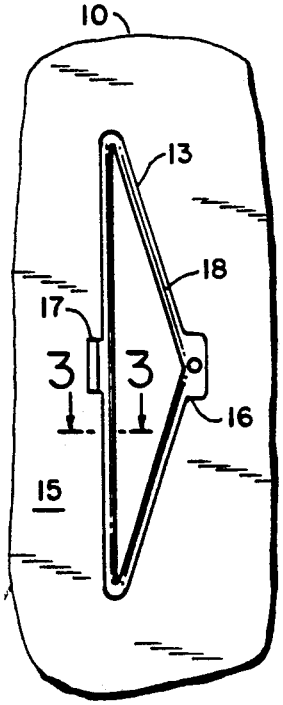
FIG. 2 is a plan view of a portion of the rear surface of the stencil illustrating an arrow void.

FIG. 2 is a plan view of the rear surface 15 of the stencil in the area of the arrow void 13. Formed in the rear surface 15 is a notch 16 in the region which encompasses the directional point of the arrow void. Also formed in the surface 15 along the void edge opposite the arrow directional point is a removal recess 17. The void edge has a bead 18 which is best illustrated in the exploded cross-sectional view of FIG. 3. The bead 18 is centrally positioned on the void edge and forms a rim 24 adjacent the front surface 14.

Figure 4:
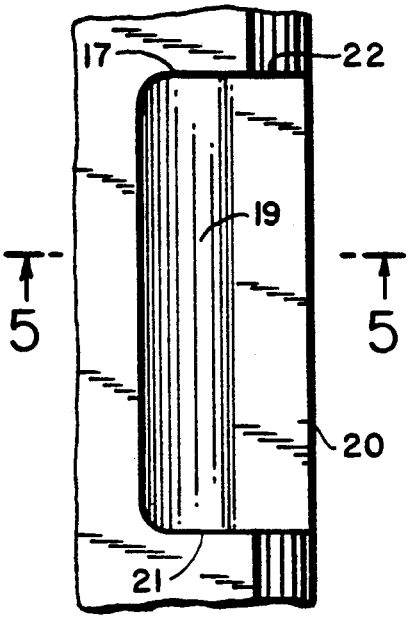
FIG. 4 is an exploded plan view of the rear surface of the stencil illustrating the removal recess of FIG. 2.
Figure 5:
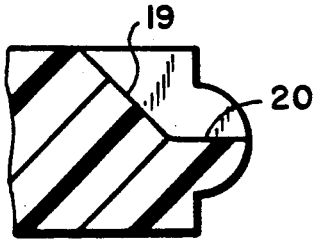
FIG. 5 is a cross-sectional view taken along the lines 5—5 of FIG. 4.

The removal recess 17 is further illustrated in the exploded plan view of FIG. 4 and the cross-sectional view of FIG. 5 taken along the lines 5—5 of FIG. 4. The recess 17 is formed partially in the bead 18 and partially in the stencil material adjacent the void so as to provide an access for a screwdriver head for the purposes of removing an inserted arrow cover. To this end, the recess 17 has a sloped portion 19 in the adjacent stencil material and a portion 20 which dissects the bead 18. Both of the surfaces 19 and 20 are bounded by recess edges 21 And 22 which extend into the stencil perpendicularly from the rear surface 15.

Figure 6:
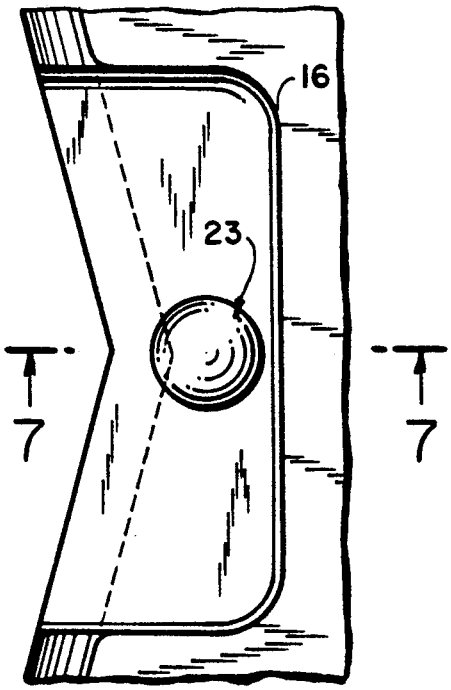
FIG. 6 is an exploded plan view of the arrowhead and notch portions of the rear surface of the stencil.
Figure 7:
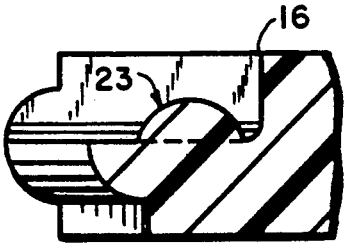
FIG. 7 is a cross-sectional view taken along the lines 7—7 of FIG. 6.
Figure 8:
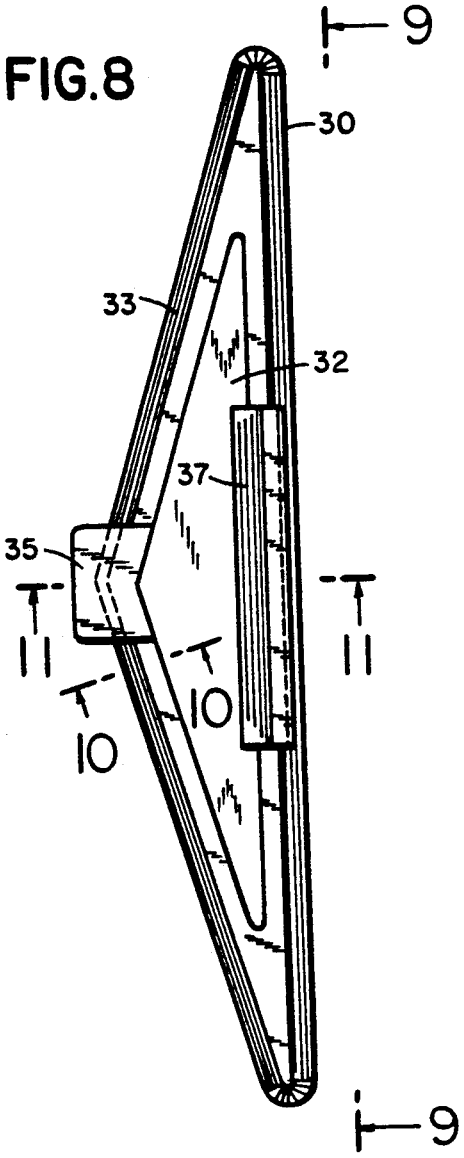
FIG. 8 is a plan view of the rear surface of the insertable arrow cover.
Figure 9:
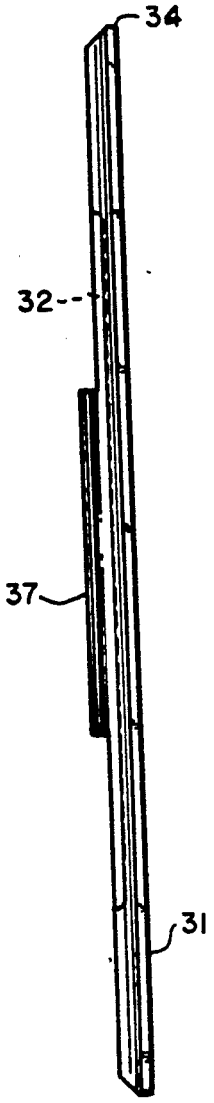
FIG. 9 is a side elevational view of the arrow cover.
Figure 10:
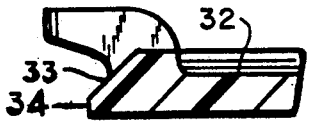
FIG. 10 is a cross-sectional view taken along the lines 10—10 of FIG. 8.
Figure 11:
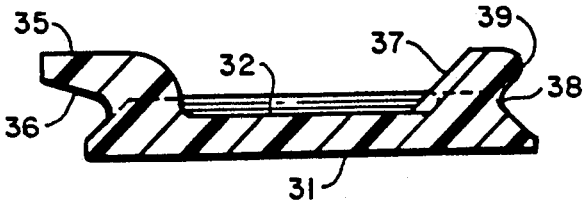
FIG. 11 is a cross-sectional view of the arrow cover taken along lines 11—11 of FIG. 8.

Notch 16 is best seen in the exploded plan view of FIG. 6 and the cross-sectional view of FIG. 7 which is taken along the lines 7—7 of FIG. 6. Notch 16 extends from the near stencil surface 15 into the stencil material to a point about midway the bead 18. Disposed centrally within the notch 16 is a pressure pad 23 which takes the form of a spherical bump. The pressure pad 23 serves to control the tightness or the snugness of the arrow cover fit so as to avoid looseness and rattles.

The arrow cover 30 as illustrated in FIGS. 8-11 is exploded from the scales of FIGS. 1-7. However, the arrow cover 30 has substantially identical shape and front surface dimensions as those of the arrow voids 12 and 13 so as to be insertable therein with a snug fit flush with the stencil front surface.

The arrow cover 30 has a front surface 31 (FIG. 9-11) and a rear surface 32. Each of the arrow edges has a bevel 33 which extends from the rear surface 32 toward the front surface 31 but stops short thereof so as to provide a rim 34. Bevel 33 facilitates insertion of the arrow cover by sliding action on the bead 18 of the stencil void as well as a snug and light free fit when fully inserted. When fully inserted, the rim 34 fits snugly within the rim 24 boundary of the void 1 2 or 13, as the case may be.

Formed on the rear surface 32 in the area of the arrow directional point is a tongue 35 which extends forward of the directional point so as to fit within the notch 16 of the stencil void during the insertion process as well as when fully inserted. The tongue 35 is sloped at 36 so as to engage the pressure point 23 (FIGS. 6 and 7) upon insertion.

Figure 3:
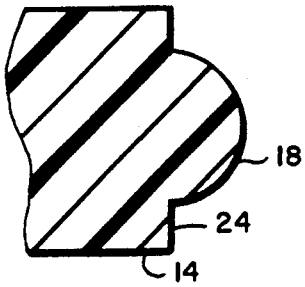
FIG. 3 is a sectional view which has been exploded and taken along the lines 3—3 of FIG. 2.

Also formed on the rear surface 32 and along the edge opposite the directional point of the arrow cover 30 is a snap rail 37. The snap rail 37 is elongated and positioned in the illustrated embodiment directly opposite the arrow directional point. The geometry of the snap rail 37 is such as to provide with the bevel 33 a groove 38 which in the fully inserted position mates with the bead 18 of the stencil void. The snap rail 37 is also rounded at 39 to facilitate a snap action insertion and removal with its mating bead 18 and removal recess 17 (FIGS. 3-5).

The exit stencil and directional arrow cover of this invention may be constructed of any suitable material, but preferably are fabricated with a thermoplastic material such as, ABS, polycarbonate or polyphenylene oxide by an injection molding process.

For insertion, the arrow cover 30 is initially positioned such that its tongue 35 is partially within the stencil notch 16 with the sloped tongue surface 36 (FIG. 11) bearing against the pressure pad 23 (FIGS. 6 and 7). Pressure is then applied to the arrow cover front surface 31 in the region of the snap rail 37 in a direction that (1) urges the arrow cover forwardly into the notch with tongue surface 36 sliding over pressure pad 23 and (2) allows the snap rail to slide and snap over the stencil void bead 18.

Removal of the arrow cover from the stencil is accomplished by applying pressure to the rear surface 32 in the region of the snap rail 37. This can be done manually or with the aid of a tool such as a screw driver inserted into the removal recess 19.

It will be appreciated that the sign stencil and arrow cover of this invention is universal for applications that require a directional indication to the right or to the left or no direction indication at all. The arrow covers and stencils are not damaged during the insertion or removal process and are therefore reusable. Accordingly, mistakes or errors that are made in arrow insertion or removal on the job do not result in either the stencil or the arrow cover being useless. An arrow cover wrongly inserted is merely removed and an arrow cover wrongly removed is merely reinserted.

It will thus be seen that the objects set forth above, among those made apparent from the preceding description, are efficiently attained and, since certain changes may be made in the above embodiment without departing from the scope of the invention, it is intended that all matter contained in the above description or shown in the accompanying drawing shall be interpreted as illustrative and not in a limited sense.

It is also to be understood that the following claims are intended to cover all the generic and specific features of the invention herein described, and all statements of the invention which, as a matter of language might be said to fall therebetween.

What is claimed is:

1. Sign apparatus having an opaque stencil with front and rear surfaces, and having a pattern of voids extending from the front to the rear surfaces thereof for an illuminated sign which in operation acts to illuminate the pattern of voids, at least one of the voids being arrow-shaped which is adapted to be obscured by an arrow-shaped cover, the improvement which comprises:

the cover having front and rear surfaces and a plurality of edges and an arrow shape substantially identical to, and a size slightly less than, the arrow shaped void so as to fit snugly into said arrow-shaped void such that the front surface of the cover is flush with the stencil front surface, the cover having a directional point and an edge opposite the cover directional point;

the arrow-shaped void having a directional point and having an edge opposite the directional point; and securing means located on the arrow-shaped cover and the arrow-shaped void to achieve a snug fit, said securing means including:

a notch in the rear surface of the stencil partially encompassing the directional point of the arrow-shaped void, a bead formed on the edge of the arrow-shaped void opposite the void directional point, a tongue mounted on the rear surface of the arrow-shaped cover for slidable insertion into said notch, and a snap rail mounted on the edge of the arrow-shaped cover opposite the directional point and shaped to slide and snap over the bead upon insertion of the arrow-shaped cover into the arrow-shaped void.

2. Sign apparatus as defined in claim 1, wherein the bead extends along each edge of the arrow-shaped void, and the edges of the arrow cover have a bevel which provides a snug and light-free fit against the bead formed on the arrow shaped void edge.

3. Sign apparatus as defined in claim 2, wherein a pressure pad is located within the notch of the stencil so as to assure a snug and tight fit of the arrow-shaped cover within the arrow-shaped void.

4. Sign apparatus as defined in claim 3, wherein the tongue has a sloped surface which during insertion slidably engages the pressure pad and when fully inserted, provides a wedge fit so as to assure the snugness of the fit.

5. Sign apparatus as defined in claim 4, wherein the bead is located so as to form adjacent the stencil front surface a rim about the arrow-shaped void.

6. Sign apparatus having an opaque stencil, said stencil having a planar front surface containing a pattern of voids for an illuminated sign which in operation acts to illuminate the pattern in said stencil, at least one of the voids being arrow-shaped which is adapted to be obscured by an arrow-shaped cover, the improvement which comprises:

the cover having an entirely planar front surface and a rear surface, said cover being formed to have an arrow shape substantially identical to, and a size slightly less than, the arrow-shaped void so as to fit snugly into said arrow-shaped void and flush with the stencil front surface; and securing means located on the rear surface of the arrow-shaped cover and on the arrow-shaped void to achieve said snug fit, said securing means including at least one notch in the rear surface of the stencil, a snap means arranged on an edge of the arrow-shaped void; at least one tongue, mounted on the rear surface of the arrow-shaped cover at one end thereof, for slidable insertion into said notch, and at least one snap rail, mounted on an edge of the arrow-shaped cover at the opposite end of the cover from said tongue, for snapping over said snap means on the edge of the arrow-shaped void upon insertion of the arrow-shaped cover into the arrow-shaped void.

7. Sign apparatus as defined in claim 6, in which said arrow-shaped void has a directional point and said snap means is a bead located opposite the arrow-shaped void directional point.

8. Sign apparatus having an opaque stencil, said stencil having a planar front surface containing a pattern of voids for an illuminated sign which in operation acts to illuminate the pattern in said stencil, at least one of the stencil voids being arrow-shaped which is adapted to be obscured by an arrow-shaped cover, the improvement which comprises:

the cover having an entirely planar front surface and a rear surface, said cover being formed to have an arrow shape substantially identical to the arrow-shaped void so as to fit snugly into said arrow-shaped void;

securing means located on the rear surface of the arrow-shaped cover and on the arrow-shaped void to achieve said snug fit, said securing means including at least one notch in the rear surface of the stencil, a snap means arranged on an edge of the arrow-shaped void; at least one tongue, mounted on the rear surface of the arrow-shaped cover at one end thereof, for slidable insertion into said notch, and at least one snap rail, mounted on an edge of the arrow-shaped cover at the opposite end of the cover from said tongue, for snapping over said snap means on the edge of the arrow-shaped void upon insertion of the arrow-shaped cover into the arrow-shaped void.

* * * * *